US008112019B2

(12) United States Patent
Onoda et al.

(10) Patent No.: US 8,112,019 B2
(45) Date of Patent: Feb. 7, 2012

(54) DEVELOPER SUPPLY DEVICE

(75) Inventors: Suzue Onoda, Aichi (JP); Kenjiro Nishiwaki, Aichi (JP); Kazutoshi Kotama, Aichi (JP); Tomoaki Hattori, Aichi (JP)

(73) Assignee: Brother Kogyo Kabushiki Kaisha, Nagoya, Aichi (JP)

( * ) Notice: Subject to any disclaimer, the term of this patent is extended or adjusted under 35 U.S.C. 154(b) by 93 days.

(21) Appl. No.: 12/730,743

(22) Filed: Mar. 24, 2010

(65) Prior Publication Data

US 2010/0247157 A1 Sep. 30, 2010

(30) Foreign Application Priority Data

Mar. 25, 2009 (JP) ..... 2009-074320

(51) Int. Cl.
*G03G 15/08* (2006.01)

(52) U.S. Cl. ..... 399/281; 399/282

(58) Field of Classification Search ..... 399/265–267, 399/280–282, 289–291
See application file for complete search history.

(56) References Cited

U.S. PATENT DOCUMENTS

| | | | | |
|---|---|---|---|---|
| 6,175,707 | B1 * | 1/2001 | Eklund et al. | 399/265 |
| 6,272,296 | B1 | 8/2001 | Gartstein | |
| 6,272,305 | B1 * | 8/2001 | Liu | 399/266 |

FOREIGN PATENT DOCUMENTS

| | | |
|---|---|---|
| JP | 60-115962 | 6/1985 |
| JP | 11-084862 | 3/1999 |
| JP | 2001-209246 | 8/2001 |
| JP | 2002-287495 | 10/2002 |
| JP | 2008-152183 | 7/2008 |

* cited by examiner

*Primary Examiner* — Hoang Ngo
(74) *Attorney, Agent, or Firm* — Banner & Witcoff, Ltd.

(57) ABSTRACT

A developer supply device, comprising: a carrying substrate having electrodes arranged along a developer transport path at predetermined intervals to carry a developer through a traveling electric field, wherein the carrying substrate comprises: a rigid upper carrying substrate formed to stand to carry the developer upward; and a flexible bottom carrying substrate curved to be a semispherical shape and is configured to charge the developer by friction with the developer and to be connected with a lower end portion of the upper carrying substrate so as to form a bottom surface of a developer reservoir portion, and wherein a joint portion of the bottom carrying substrate connected to the lower end portion is overlapped with the lower end portion such that the joint portion carries the developer in a same direction as a direction in which the developer is carried by the lower end portion.

10 Claims, 6 Drawing Sheets

DEVELOPER SUPPLY DEVICE

CROSS-REFERENCE TO RELATED APPLICATION

This application claims priority under 35 U.S.C. §119 from Japanese Patent Application No. 2009-074320, filed on Mar. 25, 2009. The entire subject matter of the application is incorporated herein by reference.

BACKGROUND

1. Technical Field

Aspects of the present invention relate to a developer supply device configured to carry a charged developer through an electric field to supply the charged developer to a supply target.

2. Related Art

Developer supply devices configured to supply a charged developer to a supply target have been widely used. On of such developer supply devices is configured to have a plurality of carrying electrodes arranged along a developer transport direction so that the developer can be carried through an electric field generated by voltage application to the plurality of electrodes.

SUMMARY

It is understood that, in such a developer supply device, if a supply state of the developer is deteriorated, the quality of a formed image is deteriorated.

Aspects of the present invention are advantageous in that a developer supply device configured to bring a supply state of a developer to a suitable state so that excellent image formation can be performed is provided.

According to an aspect of the invention, there is provided a developer supply device, comprising: a carrying substrate having a plurality of electrodes arranged along a developer transport path at predetermined intervals to carry a developer along the developer transport path through a traveling electric field. The carrying substrate comprises: an upper carrying substrate that is formed of a rigid substrate and is formed to stand to carry the developer upward; and a bottom carrying substrate that is formed of a flexible substrate curved to be a semispherical shape when viewed as a side cross section, and is configured to charge the developer by friction with the developer and to be connected with a lower end portion of the upper carrying substrate so as to form a bottom surface of a developer reservoir portion. In this configuration, a joint portion of the bottom carrying substrate which is an end where the bottom carrying substrate is connected to the lower end portion of the upper carrying substrate is overlapped with the lower end portion of the upper carrying substrate such that the joint portion carries the developer in a same direction as a direction in which the developer is carried by the lower end portion of the upper carrying substrate.

BRIEF DESCRIPTION OF THE ACCOMPANYING DRAWINGS

DETAILED DESCRIPTION

Hereafter, an embodiment according to the invention will be described with reference to the accompanying drawings.

Figure 1:
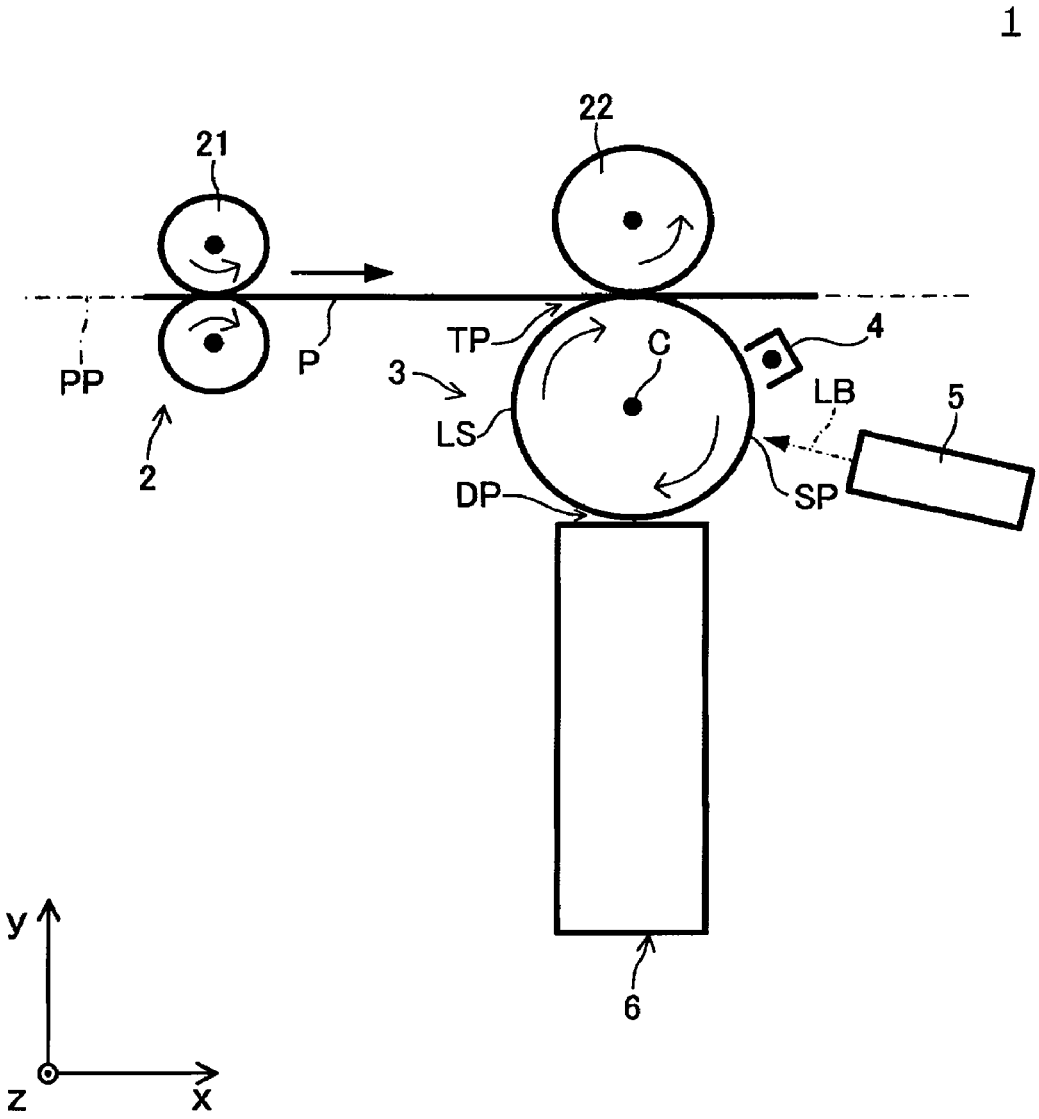
FIG. 1 is a side view illustrating a general configuration of a laser printer according to a first embodiment.

As shown in FIG. 1, a laser printer 1 includes a paper carrying mechanism 2, a photosensitive drum 3, a charger 4, a scanning unit 5 and a toner supply unit 6. On a paper supply tray (not shown) provided in the laser printer 1, a stack of sheets of paper is accommodated. The paper carrying mechanism 2 is configured to carry a sheet of paper P along a paper carrying path PP. An outer circumferential surface of the photosensitive drum 3 which is a supply target is formed to be an electrostatic latent image holding surface LS. The electrostatic latent image holding surface LS is formed as a cylindrical surface elongated in parallel with a main scanning direction (i.e., a direction of z-axis in FIG. 1). On the electrostatic latent image holding surface LS, an electrostatic latent image is formed as potential distribution, and toner T (developer) is held at portions corresponding to the electrostatic latent image.

The photosensitive drum 3 is configured to rotate in a direction indicated by an arrow in FIG. 1 (i.e., in the clockwise direction) about the center axis C extending in the main scanning direction. That is, the photosensitive drum 3 is configured such that the electrostatic latent image holding surface LS moves along an auxiliary scanning direction which is perpendicular to the main scanning direction.

The charger 4 is located to face the electrostatic latent image holding surface LS. The charger 4 is a corotron type charger or a scorotron charger, and is configured to charge uniformly the electrostatic latent image holding surface LS.

The scanning unit 5 is configured to emit a laser beam LB modulated based on image data. That is, the scanning unit 5 emits the laser beam LB which is on/off modulated in accordance with presence/absence of pixel data and which has a predetermined wavelength band. Further, the scanning unit 5 is configured to converge the laser beam LB at a scan position SP on the electrostatic latent image holding surface LS. The scan position SP is located on the downstream side in the rotational direction of the photosensitive drum 3 with respect to the charger 4.

Further, the scanning unit 5 is configured to scan the laser beam LB, at the converged position, on the electrostatic latent image holding surface LS in the main scanning direction at a constant speed, so that an electrostatic latent image is formed on the electrostatic latent image holding surface LS.

The toner supply unit 6 is located under the photosensitive drum 3 to face the photosensitive drum 3. The toner supply unit 6 is configured to supply the toner T, which is in a charged state, to the electrostatic latent image holding surface LS at a development position DP. The development position DP is a position at which the toner supply unit 6 faces the electrostatic latent image holding surface LS. The detailed configuration of the toner supply unit 6 is explained later.

Hereafter, each of the components of the laser printer 1 is explained in detail.

The paper carrying mechanism 2 includes a pair of registration rollers 21, and a transfer roller 22. The pair of registration rollers 21 is configured to send the sheet of paper P at predetermined timing toward a position between the transfer roller 22 and the photosensitive drum 3.

The transfer roller 22 is located such that the sheet of paper P is sandwiched at a transfer position TP between the transfer roller 22 and the photosensitive drum 3. Further, the transfer roller 22 is configured to be rotated in the direction indicated by an arrow in FIG. 1 (i.e., in the counterclockwise direction).

The transfer roller 22 is connected to a bias power source (not shown) so that a predetermined transfer voltage for transferring the toner adhered on the electrostatic latent image holding surface LS to the sheet of paper P is applied thereto.

Figure 2:
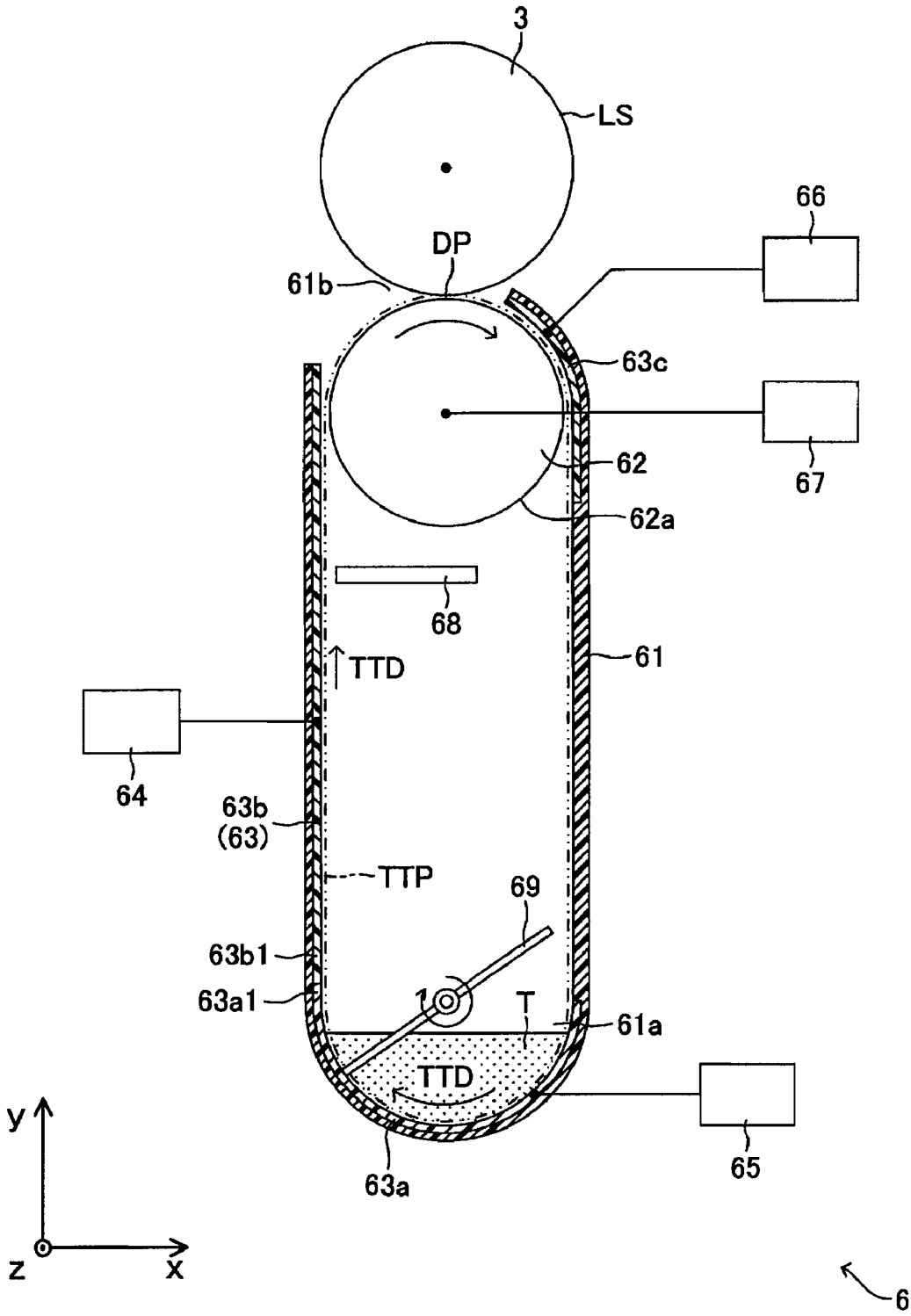
FIG. 2 is an enlarged side cross section illustrating a configuration of a toner supply unit shown in FIG. 1.

As shown in FIG. 2, the toner supply unit 6 is configured to supply the charged toner T to the photosensitive drum 3 by carrying the charged toner T through an electric field along a toner transport path TTP.

A toner box 61 serving as a casing of the toner supply unit 6 is a box type member having an elliptical shape when viewed as a side cross section, and is positioned such that the longer side thereof is in parallel with the vertical direction (i.e., the direction of y-axis). Inside the toner box 61, the toner T which is dry type powdery developer is accommodated. That is, a toner reservoir part 61*a* is formed by semicylindrical inside space formed at the lower end portion of the toner box 61. In this embodiment, the toner T has a positive electrostatic property, and is single component black toner having a nonmagnetic property. At the top of the toner box 61 (i.e., the position facing the photosensitive drum 3), an opening 61*b* is formed.

Inside the toner box 61, a development roller 62 serving as a developer holding body is accommodated. The development roller 62 is held in the toner box 61 to be rotatable. The development roller 62 is a roller-like member having a toner holding surface 62*a* which is a cylindrical circumferential surface. The development roller 62 is located to face the photosensitive drum 3 through the opening 61*b*. That is, the toner box 61 and the development roller 62 are located so that, at the development position DP, the toner holding surface 62*a* of the development roller 62 is located closely to the electrostatic latent image holding surface LS of the photosensitive drum 3 via a gap having a predetermined interval (e.g., approximately 500 μm).

Inside the toner box 61, a carrying substrate 63 is provided along the toner transport path TTP. The carrying substrate 63 is fixed on the inner wall of the toner box 61. In this embodiment, the carrying substrate 63 includes a bottom carrying substrate 63*a*, a vertical carrying substrate 63*b* and a collecting substrate 63*c*. The inner configuration of the carrying substrate 63 is explained in detail later.

The bottom carrying substrate 63*a* is located at the bottom in the inner space of the toner box 61 to form the bottom surface of the toner reservoir 61*a*. The bottom carrying substrate 63*a* which is a flexible substrate, and is formed as a recessed curved surface which is curved to have a semicylindrical shape when viewed as a side cross section. Further, the bottom carrying substrate 63*a* is configured to carry the toner T stored in the toner reservoir 61*a* to the vertical carrying substrate 63*b*.

At a joint portion 63*a*1 which is formed at an upper end of the bottom carrying substrate 63*a* on the side of the vertical carrying substrate 63*b*, the bottom carrying substrate 63*a* is smoothly connected to a lower end portion 63*b*1 of the vertical carrying substrate 63*b* so that the toner T being carried through an electric field is smoothly passed to the lower end portion 63*b*1 of the vertical carrying substrate 63*b*. That is, the joint portion 63*a*1 of the bottom carrying substrate 63*a* and the lower end portion 63*b*1 of the vertical carrying substrate 63*b* are located to overlap with each other so that the toner T is carried in the same direction both in the joint portion 63*a*1 and the lower end portion 63*b*1. The overlapped region of the bottom carrying substrate 63*a* and the vertical carrying substrate 63*b* is explained in detail later.

The vertical carrying substrate 63*b* is a rigid substrate having a plate-like shape, and is positioned to stand to carry the toner T upward in the vertical direction. The vertical carrying substrate 63*b* is configured to carry the toner T, which has passed from the bottom carrying substrate 63*a*, to the development roller 62 and the development position DP in a toner transport direction TTD.

In this embodiment, an upper end portion of the vertical carrying substrate 63*b* is situated at a position higher than the center of the development roller 62. More specifically, the upper end portion of the vertical carrying substrate 63*b* is provided to reach the opening 61*b*. The upper end portion of the vertical carrying substrate 63*b* is curved to be a recessed part so as to face the cylindrical toner holding surface 62*a* of the development roller 62 via a constant gap (e.g., about 300 μm).

The collecting substrate 63*c* is located to face the development roller 62 on a side opposite to the upper end portion of the vertical carrying substrate 63*b*, while sandwiching the development roller 62 between the upper end portion of the vertical carrying substrate 63*b* and the collecting substrate 63*c*. That is, the collecting substrate 63*c* is located on a downstream side of the opening 61*b* of the toner box 61 in the toner transport direction TTD. In this embodiment, a termination of the collecting substrate 63*c* in the toner transport direction TTD is situated at a position corresponding to a lower end of the development roller 62.

The collecting substrate 63*c* is configured to carry the toner T, which has not consumed at the development position DP, from the development roller 62, and to carry the collected toner T downwardly to the toner reservoir 61*a*. More specifically, the upper portion of the collecting substrate 63*c* is formed to face the development roller 62 via a certain gap (about 300 μm which is narrower than the gap between the photosensitive drum 3 and the development roller 62 at the development position DP). The lower end of the collecting substrate 63*c* is formed to carry the toner downward.

The vertical carrying substrate 63*b* is electrically connected to a carrying power circuit 64. The carrying power circuit 64 outputs a voltage to enable the vertical carrying substrate 63*b* to carry the toner T to the position where the vertical carrying substrate 63*b* faces the development roller 62.

The bottom carrying substrate 63*a* is electrically connected to a bottom carrying power circuit 65. The bottom carrying power circuit 65 outputs a voltage to enable the bottom carrying substrate 63*a* to carry the toner T by a stronger carrying force than the carrying force of the vertical carrying substrate 63*b*. That is, an amplitude of the output voltage of the bottom carrying power circuit 65 is larger than an amplitude of the output voltage of the carrying power circuit 64.

The collecting substrate 63*c* is electrically connected to a collecting power circuit 66. A development bias power circuit 67 is electrically connected to the development roller 62.

The carrying power circuit 64, the bottom carrying power circuit 65, the collecting power circuit 66 and the development bias power circuit 67 are configured to output voltages required to circulate the toner T along the toner transport path TTP in the toner transport direction TTD. That is, the toner T in the toner reservoir 61*a* is held tentatively on the development roller 62 to supply the toner T to the photosensitive drum 3, and the toner T which has not consumed at the development position DP is collected from the development roller 62 to be circulated to the toner reservoir 61*a* located downward.

At a position close to the vertical carrying substrate 63*b* under the development roller 62 in the inner space of the toner box 61, a shield 68 is provided. The shield 68 is provided so that the toner T flying in the inner space of the toner box 61 due to the motion of the carrying substrate 63 is prevented from being adhered to the development roller 62.

At the bottom of the inner space of the toner box 61, an agitator 69 is accommodated. The agitator 69 has a blade, and is located such that edges of the blade of the agitator 69 slide on the surface of the carrying substrate 63. More specifically, the agitator 69 is rotated about the center axis extending in parallel with the main scanning direction so that the toner T in the toner reservoir 61*a* is stirred and the toner T accumulated at the joint portion 63*a*1 is circulated to the toner reservoir 61*a*.

Figure 3:
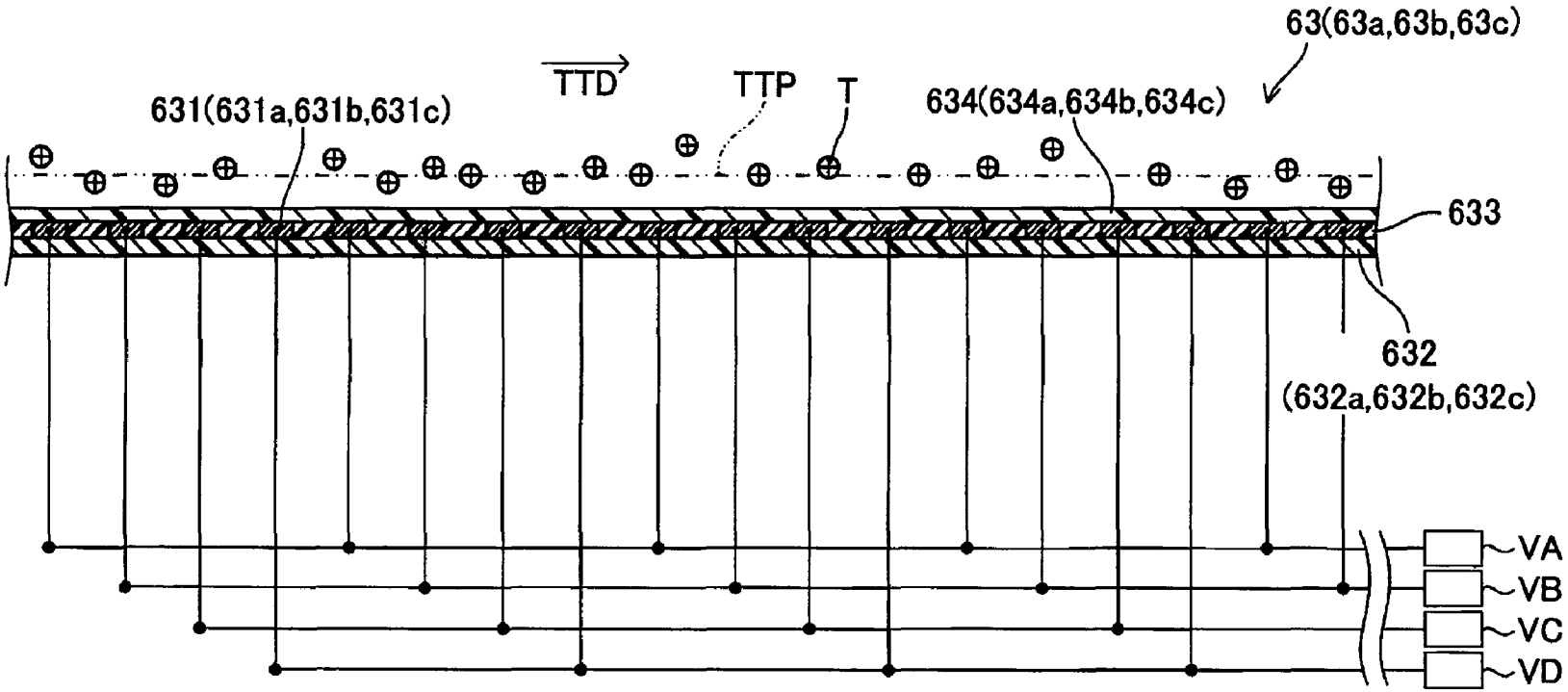
FIG. 3 is an enlarged partial side cross section of a carrying substrate provided in the toner supply device.

Referring now to FIG. 3, the carrying substrate 63 includes carrying electrodes 631, an electrode support layer 632, an insulating layer 633 and a cover layer 634.

Hereafter, the carrying electrodes 631 on the bottom carrying substrate 63*a*, the carrying electrodes 631 on the vertical carrying substrate 63*b*, and the carrying electrodes 631 on the collecting substrate 63*c* are frequently referred to as bottom carrying electrodes 631*a*, vertical carrying electrodes 631*b* and collecting electrodes 631*c*, respectively. The carrying electrodes 631 are formed as linear patterns, each of which is formed to have a longer side extending in parallel with the main scanning direction perpendicular to the auxiliary scanning direction and is formed of copper foil having a thickness of several tens of μm. The plurality of carrying electrodes 631 are aligned in parallel with each other and are arranged in the toner transport path TTP.

As shown in FIG. 3, the plurality of carrying electrodes 631 aligned along the toner transport path TTP are connected to power supply circuits VA, VB, VC and VD such that the carrying electrodes 631 are connected to the same power supply circuit at every four intervals. That is, the carrying electrode connected to the power supply circuit VA, the carrying electrode connected to the power supply circuit VB, the carrying electrode connected to the power supply circuit VC, the carrying electrode connected to the power supply circuit VD, the carrying electrode connected to the power supply circuit VA, the carrying electrode connected to the power supply circuit VB, the carrying electrode connected to the power supply circuit VC and the carrying electrode connected to the power supply circuit VD . . . are repeatedly arranged in this order along the toner transport path TTP. It should be noted that the power supply circuits VA, VB, VC and VD are provided in each of the power circuits 64-66.

Figure 4:
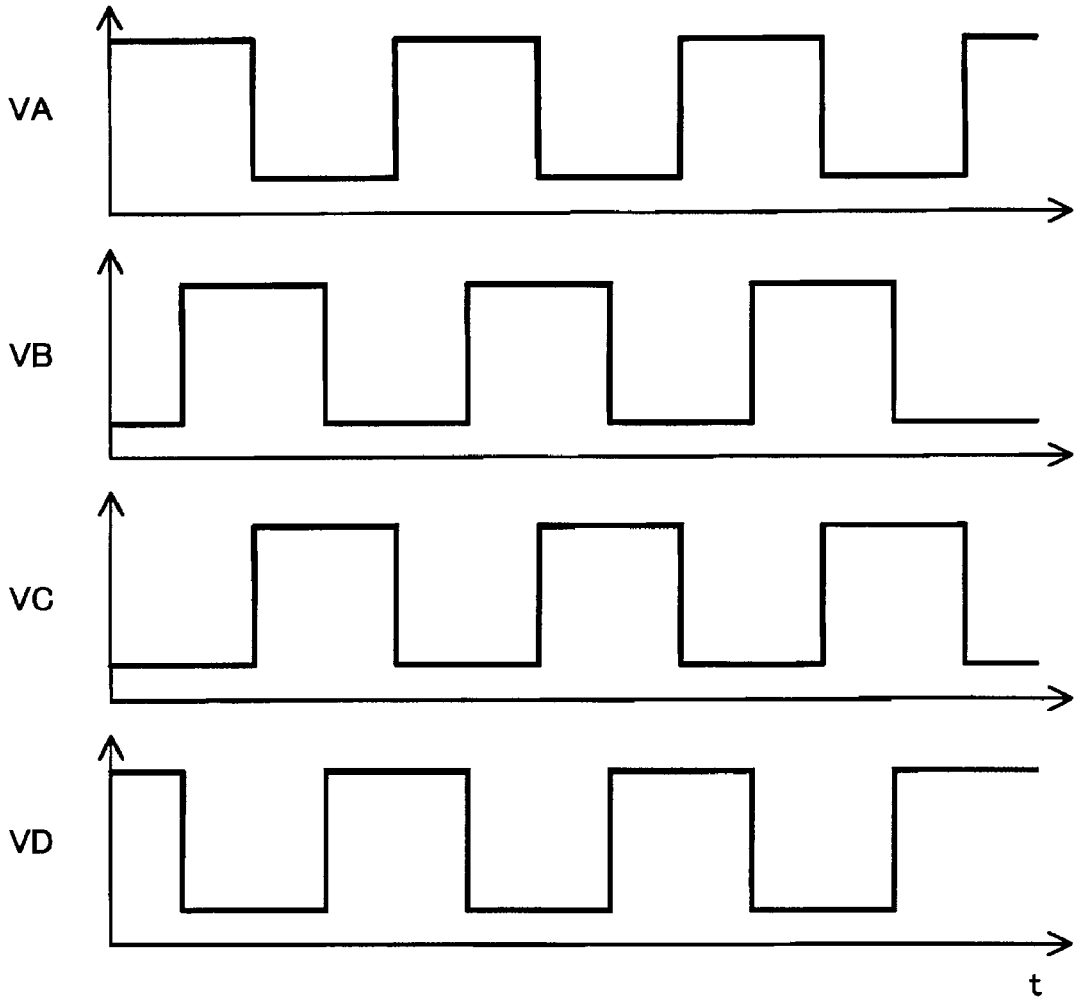
FIG. 4 is a timing chart illustrating waveforms of output signals of power supply circuits.

As shown in FIG. 4, the power supply circuits VA to VD output substantially the same driving voltages (i.e., alternating voltages). The phases of the output voltages of the power supply circuits VA to VD are shift with respect to each other by 90°. That is, in the order of the output signals of the power supply circuits VA to VD, each of the voltage phases of the output signals delays by 90°.

By applying the above described driving voltages to the carrying electrodes 631, the carrying substrate 63 generates a traveling electric field along the toner transport path TTP so that the positively charged toner T is carried in the toner transport direction TTD.

The plurality of carrying electrodes 631 are formed on the electrode support layer 632. Hereafter, the electrode support layer 632 formed on the bottom carrying substrate 63*a* is referred to as a bottom support layer 632*a*, the electrode support layer 632 formed on the vertical carrying substrate 63*b* is referred to as a vertical support layer 632*b*, and the electrode support layer 632 formed on the collecting substrate 63*c* is referred to as a collecting support layer 632*c*.

The bottom support layer 632*a* is formed of an elastic film forming a base material of the flexible substrate, and the elastic film is made of, for example, insulating synthetic resin such as polyimide resin. The vertical support layer 632*b* is formed of a glass epoxy thin plate forming a base material of the rigid substrate. As in the case of the bottom support layer 632*a*, the collecting support layer 632*c* is formed of an elastic film forming a base material of a flexible substrate, and the elastic film is made of, for example, insulating synthetic resin such as polyimide resin.

The insulating layer 633 is made of insulating synthetic resin. The insulating layer 633 is provided on a surface of the electrode support layer 632 on which the carrying electrodes 631 are formed, to fill gaps formed between adjacent ones of the carrying electrodes 631.

On the insulating layer 633 and the carrying electrodes 631, the cover layer 634 is formed. Hereafter, the cover layer 634 formed on the bottom carrying substrate 63*a*, the cover layer 634 formed on the vertical carrying substrate 63*b* and the cover layer 634 formed on the collecting substrate 63*c* are frequently referred to as a bottom cover layer 634*a*, a vertical cover layer 634*b*, a collecting cover layer 634*c*, respectively. That is, the cover layer 634 is formed to cover the carrying electrodes 631 and the insulating layer 633. A surface of the cover layer 634 is formed to be a smooth flat surface without bumps and dips so that the toner T can be carried smoothly.

In this embodiment, the vertical cover layer 634*b* and the collecting cover layer 634*c* are made of the same material (e.g., polyester). That is, as the material of the vertical cover layer 634*b* and the collecting cover layer 634*c*, material having a triboelectrification position on the plus side in the triboelectrification order with respect to the material (polyimide) of the bottom cover layer 634*a* is adopted. That is, the material of the vertical over layer 634*b* and the collecting over layer 634*c* has the same electrification polarity as that of the material of the toner T with respect to the material of the bottom over layer 634*a*.

Figure 5:
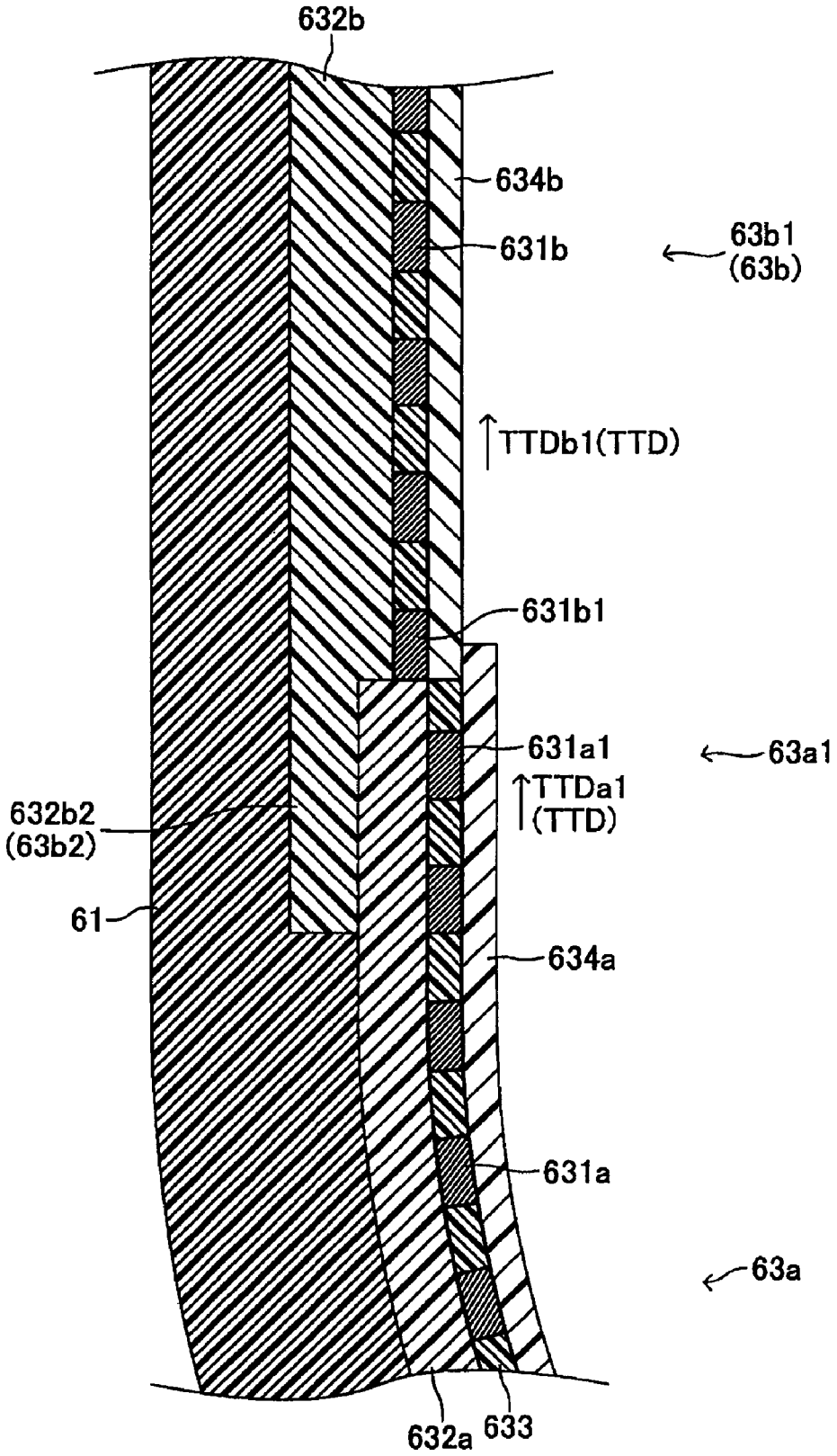
FIG. 5 is an enlarged side cross of the toner supply unit illustrating a region where a joint portion of a bottom carrying substrate and a lower end portion of a vertical carrying substrate are overlapped with each other.

Referring now to FIG. 5, the joint portion 63*a*1 which is an end of the bottom carrying substrate 63*a* connected to the lower end portion 63*b*1 of the vertical carrying substrate 63*b* is formed to be a flat plate which is in parallel with the vertical direction. That is, the joint portion 63*a*1 is overlapped with the lower end portion 63*b*1 of the vertical carrying substrate 63*b* such that a toner transport direction TTDa1 defined on the joint portion 63*a*1 is the same direction as a toner transport direction TTDb1 defined on the lower end portion 63*b*1 of the vertical carrying substrate 63*b*.

In this embodiment, the vertical carrying electrode 631*b* is not formed in a lowest end region 63*b*2 of the vertical carrying substrate 63*b*. That is, on a rear surface of the joint portion 63*a*1 on which a bottom carrying electrode 631*a* is formed, no vertical carrying electrode 631*b* is formed.

In this embodiment, the joint portion 63*a*1 and the lower end portion 63*b*1 of the vertical carrying substrate 63*n* are overlapped with each other so that an interval between a downstream end bottom electrode 631*a*1 and an upstream end vertical electrode 631*b*1 is set to be narrower than an interval between adjacent ones of the vertical carrying electrodes 631*b*. It should be noted that the downstream end bottom electrode 631*a*1 is one of the bottom carrying electrodes 631*a* situated, in the joint portion 63*a*1, at the most downstream position in the toner transport direction TTD, and that the upstream end vertical electrode 631*b*1 is one of the vertical carrying electrodes 631*b* situated, in the lowest end region 63*b*2, at the most upstream position in the toner transport direction TTD.

More specifically, the lowest end region 63*b*2 of the vertical support layer 632*b* corresponding to the lowest end region 632*b*2 (a lower region from the lower end of the upstream end vertical electrode 631*b*1) of the vertical carrying substrate 63*b* is formed to be thinner than the other part. That is, on a side of the lowest end region 63*b*2 facing the joint portion 63*a*1, a step part is formed such that a step formed at a substrate joint part by engaging with the upper end plate-like part of the bottom support layer 632*a* in the joint portion 63*a*1 can be minimized.

The step part of the joint portion 63*a*1 is formed such that a side of the upper end plate-like part of the bottom support layer 632*a*, on which the bottom carrying electrodes 631*a* are formed, is substantially flush with the outer surface of the vertical carrying electrode 631*b* and the insulating layer 633 in the lower end portion 63*b*1 of the vertical carrying substrate 63*b*. By this structure, the step formed at an electrode joint part becomes equivalent to the thickness of the bottom cover layer 634*a* at the portion where the bottom cover layer 634*a* sits on the vertical cover layer 634*b*.

With the above described arrangement of the downstream end bottom electrode 631*a*1 and the upstream end vertical electrode 631*b*1 and the step part, the distance between the center of the downstream end bottom electrode 631*a*1 and the center of the upstream end vertical electrode 631*b*1 is set to be equal to the distance between the centers of the adjacent ones of the vertical carrying electrodes 631*b* when viewed as a side cross section.

Hereafter, operations of the laser printer 1 are described.

As shown in FIG. 1, the leading edge of the sheet of paper P placed on the paper supply tray (not shown) is supplied to the registration rollers 21. By the registration rollers 21, a skew of the sheet of paper P is corrected, and the carrying timing is adjusted. Then, the sheet of paper P is carried to the transfer position TP.

While the sheet of paper P is carried to the transfer position TP, an image by the toner T is formed on the latent image holding surface LS of the photosensitive drum 3 as described below.

First, the electrostatic latent image holding surface LS of the photosensitive drum 3 is charged by the charger 4 positively and uniformly.

The electrostatic latent image holding surface LS charged by the charger 4 moves along the auxiliary scanning direction to the scan position SP where the electrostatic latent image holding surface LS faces the scanning unit 5 by rotation of the photosensitive drum 3 in the direction indicated by the arrow in FIG. 1 (i.e., in the clockwise direction).

At the scan position SP, the laser beam LB modulated in accordance with the image information scans on the electrostatic latent image holding surface LS in the main scanning direction. In accordance with the modulated state of the laser beam LB, a part of the positive charge on the electrostatic latent image holding surface LS disappears. As a result, an electrostatic latent image which is a patter of positive charges (i.e., image pattern distribution of positive charges) is formed on the electrostatic latent image holding surface LS.

The electrostatic latent image formed on the electrostatic latent image holding surface LS moves to the development position DP where the electrostatic latent image holding surface LS faces the toner supply unit 6 by rotation of the photosensitive drum 3 in the direction indicated by the arrow in FIG. 1 (i.e., in the clockwise direction).

Referring now to FIGS. 2 and 3, the toner T stored in the toner box 61 is charged by contact or friction with the bottom cover layer 634*a* of the bottom carrying substrate 63*a*. The charged toner T which contacts with or lies close to the bottom cover layer 634*a* of the bottom carrying substrate 63*a* is carried in the toner transport direction TTD and is passed to the vertical carrying substrate 63*b* at the joint portion 63*a*1 through the electric field generated by voltage application to the bottom carrying electrodes 631*a*.

The vertical carrying substrate 63*b* carries, upward in the vertical direction, the toner T passed at the lower end portion 63*b*1 from the bottom carrying substrate 63*a*. The vertical cover layer 634*b* has a lower degree of functionality of positively charging the positively charged toner T being carried than that of the bottom cover layer 634*a* of the bottom carrying substrate 63*a*. Therefore, the charged state of the developer being carried on the vertical carrying substrate can be prevented from changing.

It should be noted that the toner T passed from the bottom carrying substrate 63*a* contains toner in an improperly charged state (e.g., inversely charged toner (negatively charged toner) or non-charged toner). In this regard, according to the embodiment, when the toner T is carried upward in the vertical direction or when the toner T is held on the development roller through the effect of the electric field formed between the vertical carrying substrate 63*b* and the development roller 62, the improperly charged toner falls downward by the effect of the gravity or the effect of the above described electric field.

With this configuration, only the properly charged toner T is carried to the development roller 62 and the development position DP. That is, the properly charged toner and the improperly charged toner are suitably separated on the vertical carrying substrate 63*b*.

As described above, the positively charged toner T is supplied to the development position DP. Around the development position DP, the electrostatic latent image formed on the electrostatic latent image holding surface LS is developed with the toner T. In other words, the toner T adheres to the part of the electrostatic latent image where the positive charges have disappeared. Thus, the image formed by the toner T (hereafter, referred to as a toner image) is held on the electrostatic latent image holding surface LS.

The toner T on the toner holding surface 62*a* which has passed the development position DP (i.e., the toner T not consumed at the development position DP) moves to the collecting substrate 63*c* through the effect of the collecting bias. That is, the toner not consumed at the development position DP is collected from the toner holding surface 62*a* by the collecting substrate 63*c*.

In this embodiment, an alternating collecting bias is applied to the development roller 62. Through the effect of an alternating component of the collecting bias, the toner T close to the toner holding surface 62*a* of the development roller 62 vibrates. By such vibration, the toner T lifted from the toner holding surface 62*a* collides with the toner T adhered to the toner holding surface 62*a*. By such a collision, the toner T held on the toner holding surface 62*a* is brought to the state of being lifted easily from the toner holding surface 62*a*.

In this embodiment, the average potential (0V) of the collecting bias is set to be lower than the potential (240V) of the exposed part of the electrostatic latent image holding surface LS to which the toner T to be supplied. Furthermore, the electric field between the development roller 62 and the collecting substrate 63*c* is stronger than the electric field between the development roller 62 and the photosensitive drum 3.

Through application of such a collecting bias, the toner T which has not consumed and passed the development position DP is suitably removed from the toner holding surface 62*a*, and is moved to the collecting substrate 63*c*. Such a configuration makes it possible to prevent occurrence of a ghost on the formed image.

In this embodiment, the amplitude of the collecting bias is set to be larger than the amplitude of the voltage applied to the collecting electrodes 631*c*. Therefore, the toner T can be suitably collected from the toner holding surface 62*a* even if the voltage between adjacent ones of the collecting electrodes 631*c* are not set to be large. As a result, the insulating property between adjacent ones of the collecting electrodes 631*c* on the collecting substrate 63*c* can be kept at a suitable state.

Furthermore, the collecting bias also serves as a bias for a jumping phenomenon at the development position DP. Consequently, it becomes possible to achieve the collecting bias with a simple structure.

The toner T which has moved from the toner holding surface 62*a* to the collecting substrate 63*c* is carried downward to the toner reservoir 61*a* through the electric field generated by the voltage application to the collecting electrodes 631*c*.

In this embodiment, the frequency of the collecting bias is set at an integral multiple of the frequency of the voltage applied to the vertical carrying electrodes 631*b* or the collecting electrodes 631*c*. As a result, the electric field of the collecting bias and the electric field for transferring the toner T on the collecting substrate 63*c* become in suitable synchronization with respect to each other.

At the lower end of the collecting substrate 63*c*, the toner T is carried downward in the vertical direction. In this case, moment in the same direction as the gravity acts on the toner T. In a region lower than the lower end of the collecting substrate 63*c*, by the effect of the moment in the same direction as the gravity, the toner T falls toward the ink reservoir 61*a*. Therefore, the toner T can be suitably circulated even if the collecting substrate 63*c* is not provided to reach the ink reservoir 61*a*.

As shown in FIG. 1, the toner image held on the electrostatic latent image holding surface LS of the photosensitive drum 3 is carried to the transfer position TP by rotation of the electrostatic latent image holding surface LS in the direction indicated by the arrow in FIG. 1 (i.e., in the clockwise direction). Then, the toner image is transferred to the sheet of paper P from the electrostatic latent image holding surface LS at the transfer position TP.

Hereafter, advantages achieved by the above described embodiment are described.

In this embodiment, the joint portion 63*a*1 which is the downstream end portion in the toner transport direction TTD of the bottom carrying substrate 63*a* carries the toner T in the same direction as the direction in which the lower end portion 63*b*1 of the vertical carrying substrate 63*b* carries the toner T. In this configuration, the join portion 63*a*1 of the bottom carrying substrate 63*a* carries the toner T more strongly than the lower end portion 63*b*1 of the vertical carrying substrate 63*b*.

As shown in FIG. 5, the interval between the downstream end bottom electrode 631*a*1 and the upstream end vertical electrode 631*b*1 in the toner transport direction TTD (TTDb1) is set to be narrower than the interval between adjacent ones of the vertical carrying electrodes 631*b*. On the rear side of the joint portion 63*a*1 on which the bottom carrying electrodes 631*a* are formed, the vertical carrying electrodes 631*b* are not formed.

Furthermore, the lowest end region 632*b*2 of the vertical support layer 632*b* is formed to be thinner than the other portions. Therefore, the step at the joint portion between the bottom carrying substrate 63*a* and the vertical carrying substrate 63*b* can be formed to be small.

According to the embodiment, it is possible to smoothly pass the toner T to the lower end portion 63*b*1 of the vertical carrying substrate 63*b* in the joint portion 63*a*1 of the bottom carrying substrate 63*a*. Therefore, the supply state of the toner T with respect to the photosensitive drum can be brought to the appropriate state, and therefore it becomes possible to enable the laser printer 1 to perform suitable image formation.

According to the embodiment, the toner T is hard to accumulate at the joint portion 63*a*1. Even if the toner T accumulates at the joint portion 63*a*1, the accumulated toner T can be removed from the joint portion 63*a*1 by the agitator 69, and is circulated to the ink reservoir 61*a*.

Although the present invention has been described in considerable detail with reference to certain preferred embodiments thereof, other embodiments are possible.

Hereafter, variations of the toner supply device are explained. It should be noted that, in the following, to elements which are substantially the same as those of the above described embodiment, the same reference numbers are assigned, and explanations thereof will not be repeated.

(1) The application of the toner supply unit according to the embodiment is not limited to a monochrome laser printer. The toner supply unit 6 may be applied to various types of electrophotographic image forming devices, such as a color laser printer, a monochrome copying device, and a color copying device. In regard to the types of a photosensitive body provided in an image forming device to which the toner supply unit is applied, it is understood that the photosensitive body can take various types of shapes. That is, the shape of the photosensitive body is not limited to the drum-like shape. For example, the photosensitive body may be formed to be a plate-like shape or an endless belt.

The above described embodiment may also be applied to an image forming device which is not the electrophotographic type image forming device. For example, the above described embodiment may be applied to a toner jet type device, an ion flow type device and a multi-stylus type device which do not use a photosensitive body.

(2) The development roller 62 may contact the photosensitive drum 3.

(3) The application voltage to the development roller 62 may be formed only of a DC component (including a ground level).

(4) The waveforms of the output voltages of the power supply circuits VA to VD are not limited to the rectangular shape shown in FIG. 4. For example, sine waveforms or triangular waveforms may be employed as output voltages of the power supply circuits VA to VD.

In the above described embodiment, four power supply circuits VA to VD are provided, and phases of the output voltages of the power supply circuits VA to VD are shift by 90° with respect to each other. However, the embodiment is not limited to such a structure. For example, in another embodiment, three power supply circuits may be employed, and in this case phases of output voltages of the three power supply circuits may shift by 120° with respect to each other.

(5) The structure of the carrying substrate 63 is not limited to that illustrated in the above described embodiment.

For example, the vertical carrying substrate 63*b* may be provided to stand substantially in the vertical direction. That is, the vertical carrying substrate 63*b* may be inclined with respect to the vertical direction to some extent. Similarly, the lower end portion of the vertical carrying substrate may be inclined with respect to the vertical direction to some extent.

The central part of the bottom carrying substrate 63*a* may be formed to have a flat shape.

The termination of the collecting substrate 63*c* in the toner transport direction TTD may be connected to the bottom carrying substrate 63*a*.

Figure 6:
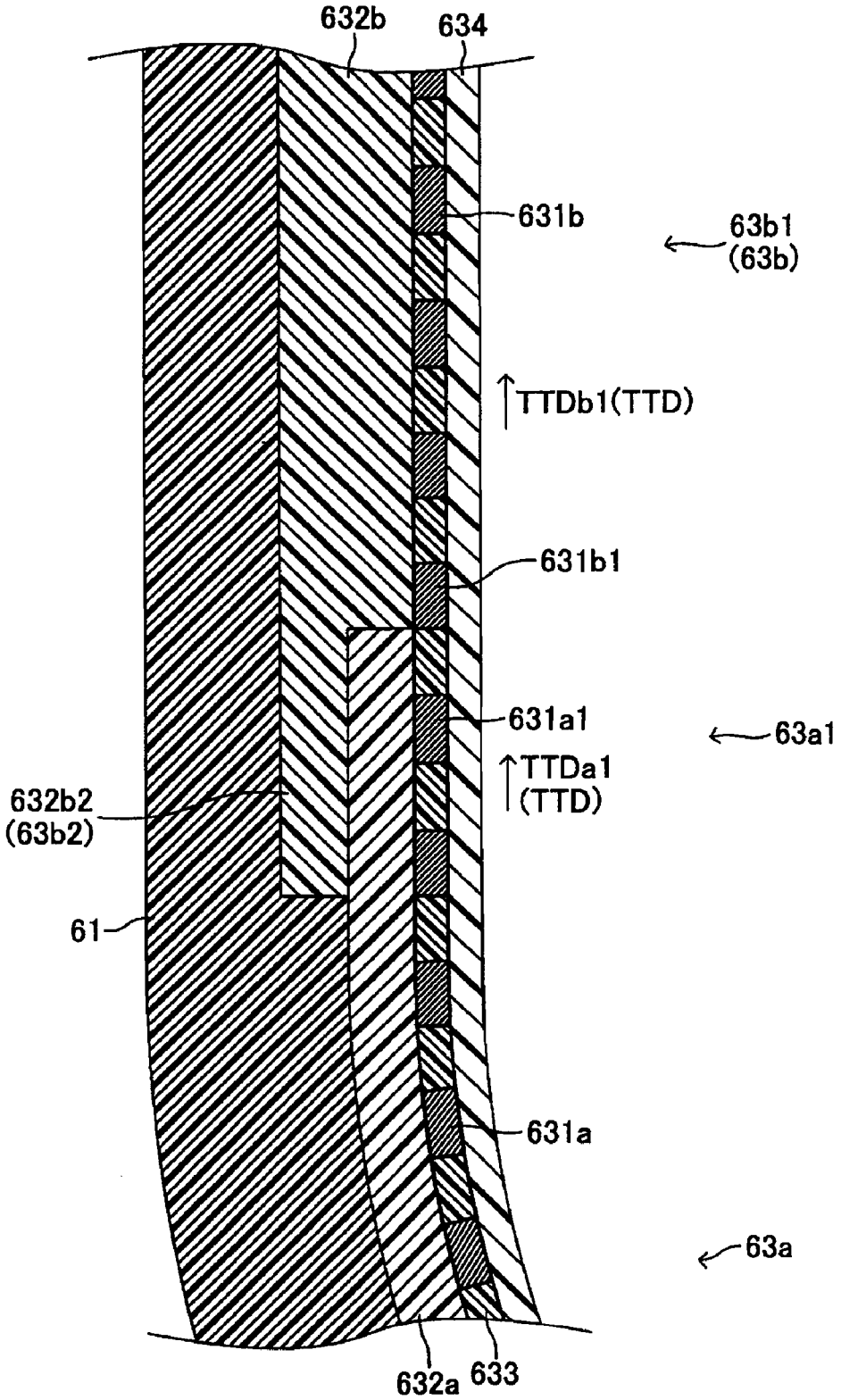
FIG. 6 is an enlarged side cross of a toner supply unit illustrating a variation of a joint portion of a bottom carrying substrate and a lower end portion of a vertical carrying substrate.

As shown in FIG. 6, the cover layer 634 may be integrally formed for the bottom carrying substrate 63*a* and the vertical carrying substrate 63*b*. In this case, by setting the thickness of the lowest end region 632*b*2 of the vertical support layer 632*b* such that the electrode formation surface of the bottom support layer 632*b* in the point portion 63*a*1 and the electrode formation surface of the vertical support layer 632*b* in the lower end portion 63*b*1 of the vertical carrying substrate 63*b* become flush with each other, the step can be formed to disappear in the joint portion.

(6) The cover layer 634 may be omitted.

What is claimed is:

1. A developer supply device, comprising:

a carrying substrate having a plurality of electrodes arranged along a developer transport path at predetermined intervals to carry a developer along the developer transport path through a traveling electric field, wherein the carrying substrate comprises:

an upper carrying substrate that is formed of a rigid substrate and is formed to stand to carry the developer upward; and a bottom carrying substrate that is formed of a flexible substrate curved to be a semispherical shape when viewed as a side cross section, and is configured to charge the developer by friction with the developer and to be connected with a lower end portion of the upper carrying substrate so as to form a bottom surface of a developer reservoir portion, wherein a joint portion of the bottom carrying substrate which is an end where the bottom carrying substrate is connected to the lower end portion of the upper carrying substrate is overlapped with the lower end portion of the upper carrying substrate such that the joint portion carries the developer in a same direction as a direction in which the developer is carried by the lower end portion of the upper carrying substrate.

2. The developer supply device according to claim 1, further comprising:

a casing having an opening formed to face a supply target and the developer reservoir portion provided at a bottom part of the casing to accommodate the developer; and a developer holding body that is a roller-like member having a cylindrical circumferential surface and is placed around the opening to be accommodated in the casing and to face the supply target, wherein:

the carrying substrate is supported on an inner wall of the casing; and the upper carrying substrate carries the developer to the developer holding body.

3. The developer supply device according to claim 2, wherein the upper carrying substrate is formed to carry the developer upward in a vertical direction to a position facing the developer holding body.

4. The developer supply device according to claim 2, further comprising an agitator configured to return the developer accumulated at the joint portion to the developer reservoir portion.

5. The developer supply device according to claim 1, wherein an interval between an upstream end one of a plurality of electrodes formed along the developer transport path in the lower end portion of the upper carrying substrate and a downstream end one of a plurality of electrodes formed along the developer transport path in the joint portion of the bottom carrying substrate is set to be smaller than or equal to a predetermined value.

6. The developer supply device according to claim 1, wherein the joint portion of the bottom carrying substrate overlaps with a lowest end region of the lower end portion of the vertical carrying substrate; and no electrode is formed in the lowest end region.

7. The developer supply device according to claim 1, wherein material of a surface layer of the upper carrying substrate has a triboelectrification position on a same polarity side as that of an electrification property of the developer with respect to material of a surface layer of the bottom carrying substrate.

8. The developer supply device according to claim 2, further comprising:

an upper carrying substrate driving unit which is electrically connected to the upper carrying substrate and is configured to output a voltage to carry the developer to a position at which the upper carrying substrate faces the developer holding body; and a bottom carrying substrate driving unit which is electrically connected to the bottom carrying substrate and is configured to output a voltage to carry the developer more strongly than the upper carrying substrate.

9. The developer supply device according to claim 1, further comprising:

an upper carrying substrate driving unit which is electrically connected to the upper carrying substrate and is configured to output a voltage to carry the developer; and a bottom carrying substrate driving unit which is electrically connected to the bottom carrying substrate and is configured to output a voltage to carry the developer more strongly than the upper carrying substrate.

10. The developer supply device according to claim 1, wherein the upper carrying substrate is configured to carry the developer upward in a vertical direction.

* * * * *